US007805811B2

(12) United States Patent
Shuker

(10) Patent No.: US 7,805,811 B2
(45) Date of Patent: Oct. 5, 2010

(54) VEHICLE DOOR HINGE

(75) Inventor: John Douglas Shuker, Leamington Spa (GB)

(73) Assignee: Multimatic Advanced Technologies, Inc. (BB)

( * ) Notice: Subject to any disclaimer, the term of this patent is extended or adjusted under 35 U.S.C. 154(b) by 767 days.

(21) Appl. No.: 10/068,641

(22) Filed: Feb. 6, 2002

(65) Prior Publication Data

US 2002/0121003 A1 Sep. 5, 2002

(30) Foreign Application Priority Data

Feb. 6, 2001 (GB) ..... 0102907.3

(51) Int. Cl.
*E05D 5/12* (2006.01)

(52) U.S. Cl. ..... 16/380; 16/386; 16/381; 16/382

(58) Field of Classification Search ..... 16/380, 16/386 X, 381, 382
See application file for complete search history.

(56) References Cited

U.S. PATENT DOCUMENTS

| | | | | | |
|---|---|---|---|---|---|
| 933,635 | A | * | 9/1909 | Durr | 119/75 |
| 1,984,350 | A | * | 12/1934 | Halsey et al. | 403/235 |
| 3,796,464 | A | * | 3/1974 | Hansen et al. | 299/104 |
| 3,827,820 | A | * | 8/1974 | Hoffman | 403/165 |
| 4,715,090 | A | * | 12/1987 | Morris | 16/261 |
| 4,800,623 | A | * | 1/1989 | Brockhaus | 16/254 |
| 4,938,496 | A | * | 7/1990 | Thomas et al. | 280/511 |
| 5,040,268 | A | * | 8/1991 | Knurr | 16/261 |
| 5,141,372 | A | * | 8/1992 | Donner | 410/82 |
| 5,412,842 | A | * | 5/1995 | Riblett | 16/334 |
| 5,452,501 | A | * | 9/1995 | Kramer et al. | 29/11 |
| 6,554,524 | B1 | * | 4/2003 | Smith | 403/78 |

FOREIGN PATENT DOCUMENTS

| | | | |
|---|---|---|---|
| DE | 1584006 | B * | 12/1976 |
| EP | 292296 | A1 * | 11/1988 |
| GB | 2 147 655 | A | 5/1985 |
| GB | 2 147 942 | A | 5/1985 |
| GB | 2313621 | A | 3/1997 |
| GB | 2 313 621 | A | 12/1997 |
| JP | S54-117458 | | 4/1988 |
| JP | S63-089079 | | 6/1988 |
| JP | H04-330185 | | 12/1991 |
| JP | H05-239971 | | 9/1993 |
| JP | 2000-197218 | | 6/2000 |

* cited by examiner

*Primary Examiner*—Peter M. Cuomo
*Assistant Examiner*—Mark Williams
(74) *Attorney, Agent, or Firm*—Kilpatrick Stockton LLP

(57) ABSTRACT

A vehicle hinge assembly (10) for hanging a vehicle door on a vehicle body. The assembly (10) comprises a first hinge leaf (12) hingedly connected to a second hinge leaf (14) by a pivot pin (15). The pivot pin (15) is immovably mounted in one hinge leaf (14) and is rotatably mounted in, and axially withdrawable from, the other hinge leaf (12). Hinge pin retention means (35) is associated with the other hinge leaf (12) for preventing axial withdrawal of the hinge pin (15) therefrom. The hinge pin retention means (35) having hinge pin engagement means (38) movably mounted between first and second positions. The engagement means (38) in its first position engages with the hinge pin (15) to permit rotation of the hinge pin (15) but prevent its axial movement relative to the other hinge leaf (12). The engagement means (38) in its second position is spaced from the hinge pin (15) to permit its axial withdrawal from the other hinge leaf (12).

22 Claims, 4 Drawing Sheets

VEHICLE DOOR HINGE

The present invention relates to a vehicle door hinge and in particular, but not exclusively, a vehicle door hinge which is particularly suitable for the hanging of a vehicle rear door.

According to a first aspect of the present invention there is provided a vehicle hinge assembly for hanging a vehicle door on a vehicle body, the assembly comprising a first hinge leaf hingedly connected to a second hinge leaf by a pivot pin, the pivot pin being immovably mounted in one hinge leaf and being rotatably mounted in, and being axially withdrawable from, the other hinge leaf, and hinge pin retention means associated with said other hinge leaf for preventing axial withdrawal of the hinge pin therefrom, the hinge pin retention means having hinge pin engagement means movably mounted between first and second positions, the engagement means in its first position engaging with the hinge pin to permit rotation of the hinge pin but prevent its axial movement relative to said other hinge leaf, and in its second position being spaced from the hinge pin to permit its axial withdrawal from said other hinge leaf.

According to a second aspect of the present invention there is provided a vehicle hinge assembly for hanging a vehicle door on a vehicle body, the assembly comprising a first hinge leaf hingedly connected to a second hinge leaf by a pivot pin, each hinge leaf comprising a body cast from a metal to define a shell including a boss having a bore in which the hinge pin is located.

According to a third aspect of the present invention there is provided a vehicle hinge assembly for hanging a vehicle door on a vehicle body, the assembly comprising a first hinge leaf and a second hinge leaf, each hinge leaf including a blind bore to receive a respective end of a pivot pin to hingedly connect the first hinge leaf to the second hinge leaf, the first and second hinge leaves each having an outer face and an inner face, the inner face, in use, respectively abutting the door or vehicle body and having fixing means that project from the inner face to secure the inner face in abutment with the door or vehicle body, and the outer face serving to shield access to the fixing means in use.

Various aspects of the present invention are hereinafter described with reference to the accompanying drawings, in which.

Figure 1:
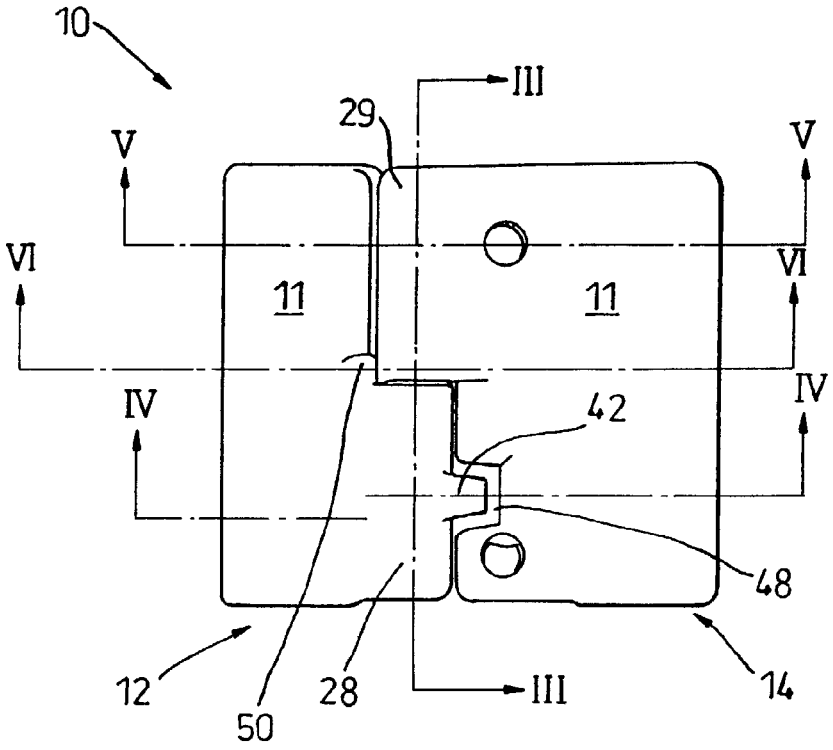
FIG. 1 is a front view of a hinge according to one embodiment of the present invention.
Figure 2:
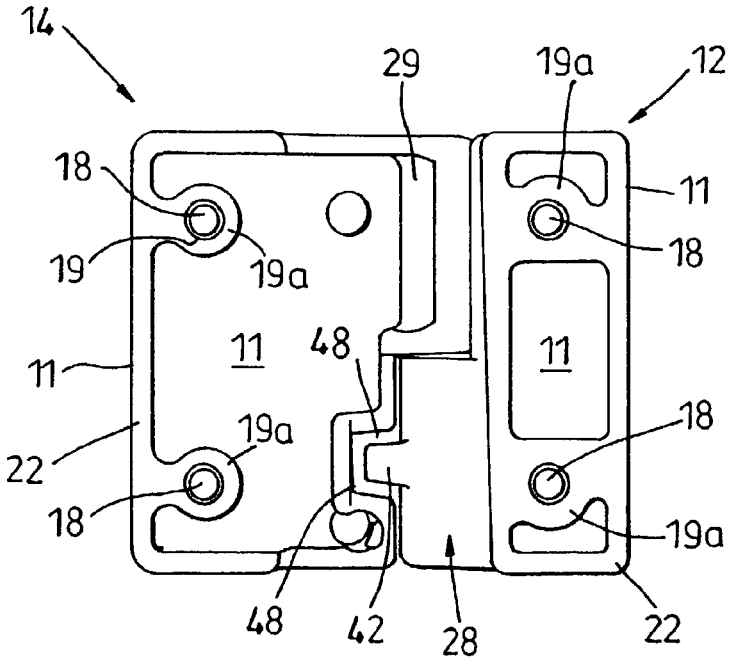
FIG. 2 is a rear view of the hinge shown in FIG. 1.

Referring initially to FIG. 1 there is shown a vehicle door hinge assembly 10 having a door hinge leaf 12 hingedly connected to a body hinge leaf 14 via a pivot shaft or pin 15.

In use, the hinge leaf 12 is connected to a vehicle door (not shown) and the hinge leaf 14 is connected to the vehicle body (not shown).

Figure 8:
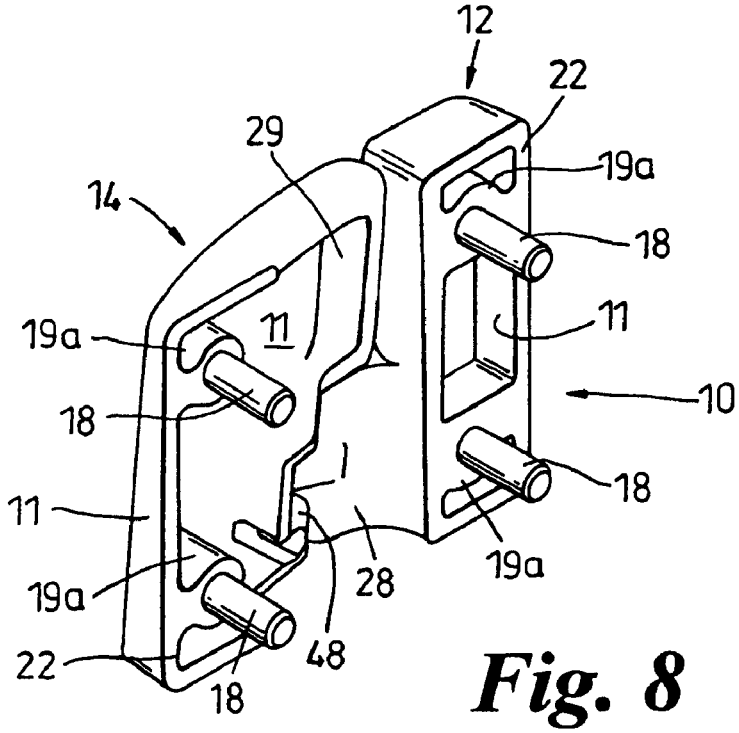
FIG. 8 is a rear perspective view of the hinge shown in FIG. 1.

Preferably each leaf 12,14 is defined by a cast body which is cast from a suitable metal, preferably a metal such as SG cast iron. Preferably, as more clearly seen in FIG. 8, the body is cast to define for each hinge leaf a generally hollow shell predominantly comprising a shell wall 11 having a relatively thin wall thickness, for example a thickness of about 4 mm. The thickness is chosen to provide each shell with the required strength.

Preferably the hinge pin 15 is fixedly secured in a blind bore 30 formed in a boss 29 cast integrally with wall 11 of hinge leaf 14 and is rotatably received in a blind bore 32 formed in a boss 28 cast integrally with wall 11 of hinge leaf 12. A bearing bush 128 is preferably located within the blind bore 32 to provide rotary support for the hinge pin 15.

In other embodiments, upper and lower bearing bushes 130,132 may be located within the blind bore 32. In such embodiments, the upper and lower bearing bushes 130,132 are preferably spaced apart, the upper bearing bush 130 being located towards the top of the blind bore 32 and the lower bearing bush being located towards the bottom of the blind bore 32. Spacing the bearing bushes 130,132 in this way maximizes the rotary support for the hinge pin 15 provided by the bearing bushes 130,132 and restricts the hinge pin 15 from skewing sideways in the blind bore 32.

The or each bearing bush 128 or 130,132 may be formed from metalloplast.

Bosses 28,29 are of greater thickness than wall 11 in order to accommodate the hinge pin 15.

The hinge pin 15 is axially withdrawable from the blind bore 32 to enable the hinge leafs to be separated.

Figure 9:
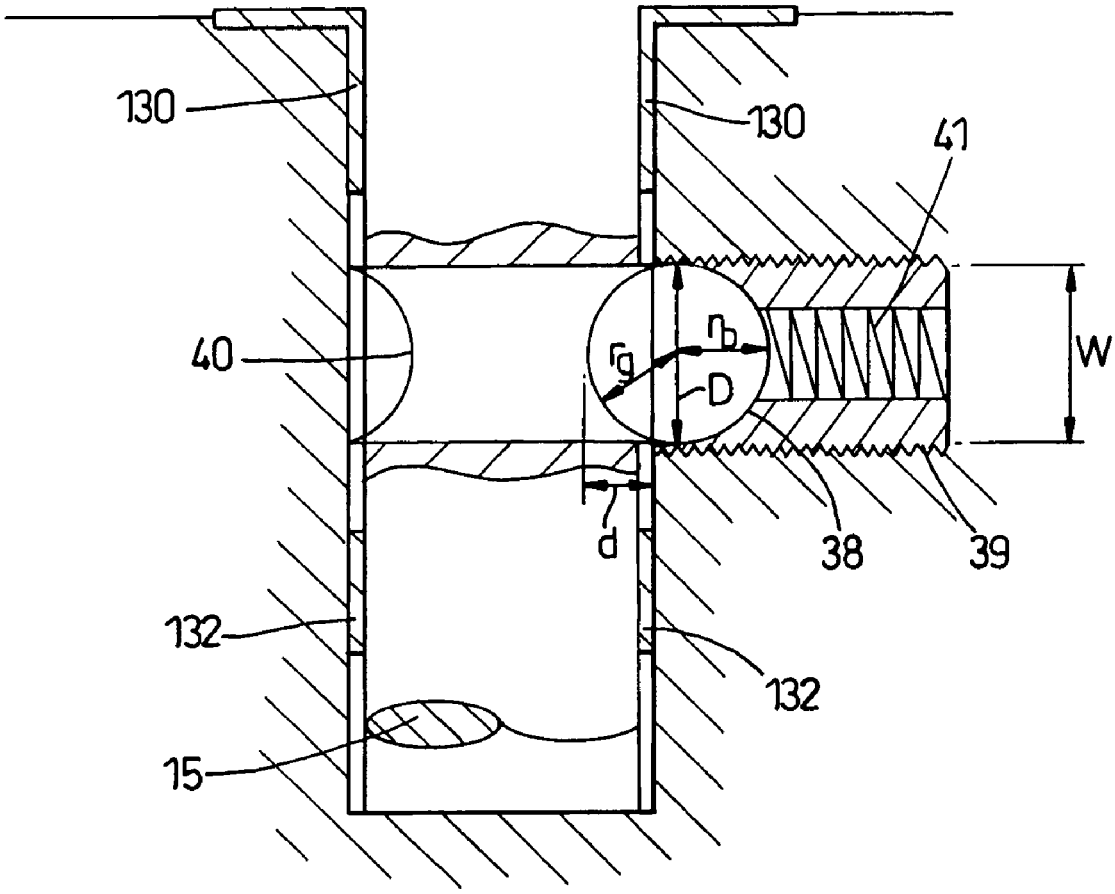
FIG. 9 is a partial sectional view of a hinge according to another embodiment of the invention.

Preferably hinge pin retention means are provided for axially retaining the hinge pin 15 within the bore 32. Preferably the hinge pin retaining means 35 includes a ball catch assembly 37 having a ball bearing 38 resiliently biased by a spring 41 (FIG. 9) into contact with an annular groove 40 extending about the hinge pin 15.

The ball 38 is preferably rotatably located in an end of a housing 39 which is preferably screw threadedly located within a bore 44 formed within a wall projection 42 on boss 28 of hinge leaf 12 and may be axially moved along bore 44 to/from the hinge pin 15 by a screwing action.

The ball 38 preferably has a diameter D greater than the depth d of the groove 40 such that when housing 39 is axially positioned within bore 44, with the ball 38 fully seated in the groove 40, axial withdrawal of the hinge pin 15 is prevented. Location of the ball 38 within groove 40 does not impede rotation of the hinge pin 15 due to the capability of the ball 38 to rotate.

It is envisaged that in other embodiments a non-rotating ball 38 may be provided in which case there would be sliding contact between the ball 38 and groove 40, a suitable lubricant being preferably provided to reduce sliding friction therebetween.

Whether a rotating or non-rotating ball 38 is used, the sizes of the groove 40, the ball 38 and the housing 39 are preferably chosen such that any freeplay between the ball 38 and the groove 40, and any freeplay between the ball 38 and the inner walls of the housing 39, is eliminated. The elimination of freeplay prevents any axial movement of the hinge pin 15.

For example, with a ball 38 having a maximum diameter D and a radius of curvature $r_b$, the groove 40 may be formed with the same radius of curvature $r_g$ as the ball 38. Although the radius of curvature $r_g$ of the groove corresponds to the radius of curvature $r_b$ of the ball 38, the depth d of the groove 40 is smaller than the radius of curvature $r_b$ of the ball 38, as indicated above. This means that when the ball 38 is in contact with the groove 40, the portion of the ball 38 having the greatest diametrical size is located within the housing 39. The width w of the housing 39 corresponds to the maximum diameter D of the ball 38. This means that when the ball 38 is in contact with the groove 40, the housing 39 engages either side of the ball 38 and prevents axial movement of the ball 38 relative to the housing 39. As a result of the groove 40 having the same radius of curvature $r_g$ as the ball 38, there is no freeplay between the groove 40 and the ball 38 when the ball 38 is in contact with the groove 40.

Such elimination of freeplay between the groove 40 and the ball 38, and the prevention of axial movement of the ball 38 relative to the housing 39, means that axial movement of the hinge pin 15 relative to the bore 32 is prevented.

In order to enable the hinge pin 15 to be axially withdrawn, it is first necessary to axially withdraw housing 39 to move the ball 38 out of registry with the groove 40.

Figure 4:
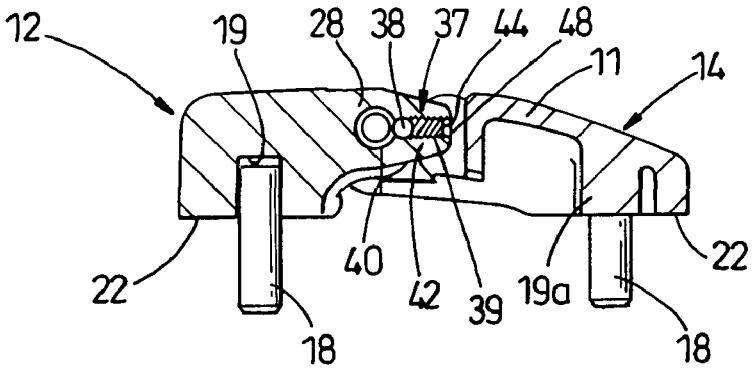
FIG. 4 is a sectional view taken along line IV-IV in FIG. 1.
Figure 5:
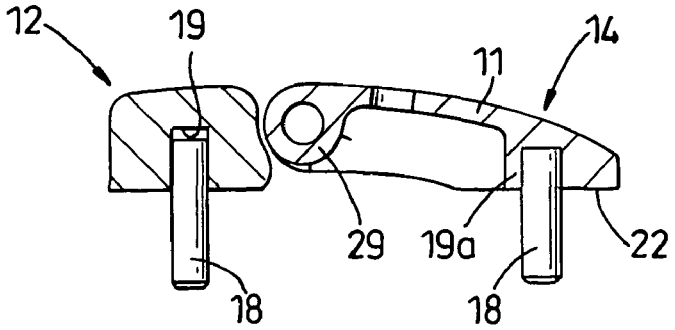
FIG. 5 is a sectional view taken along line V-V in FIG. 1.

Access to the assembly 37 for screwing it along bore 44 is gained via the open end of the bore 44. Preferably, as shown in FIG. 4, when the hinge is in its door closed position, the wall projection 42 is located within a recess 48 formed in hinge leaf 14 and so access to the open end of the bore 44 is prevented. Accordingly it is not possible to gain access to the assembly 37 whilst the door is closed and so unauthorised personnel are prevented from tampering with the assembly 37. Also, whilst the wall projection 42 is located within recess 38 the hinge leafs 12,14 are interleaved and cannot be axially separated.

Figure 6:
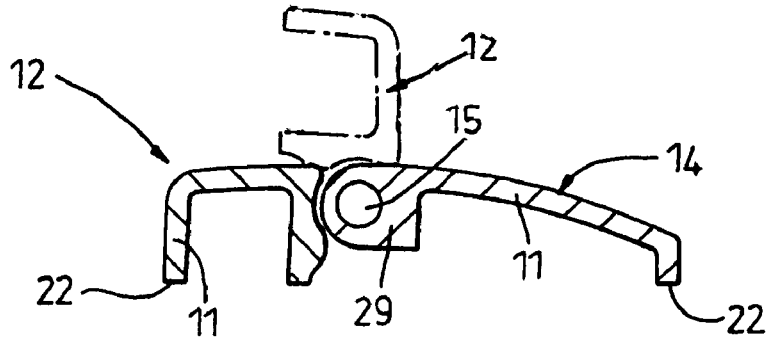
FIG. 6 is a sectional view taken along line VI-VI in FIG. 1.

Hinge leaf 12 is preferably provided with a stop formation 50 which is engageable against the front face of the hinge leaf 14 so as to define a fully open position as shown in broken lines in FIG. 6. In the fully open position, the wall projection 42 is clear of the recess 48 and so permits the hinge leafs 12,14 to be moved axially apart after overcoming the resistance imposed by the ball catch assembly 37.

Preferably both bores 30,32 are blind in order to prevent unauthorised access to the hinge pin and to prevent ingress of water/dirt and to visually conceal the location of the hinge pin 15 when viewing the hinge assembly when mounted on a vehicle. It also prevents the egress of any materials from within the hinge assembly such as, for example, lubricant. Preventing unauthorised access to the hinge pin 15 is particularly advantageous as a security feature which makes it difficult for the hinge assembly to be dismantled by unauthorised personnel. If desired, however, bore 30 and/or bore 32 may be open-ended.

Preferably connection of both the hinge leafs 12,14 to the vehicle door and body is achieved by providing each hinge leaf with a pair of laterally projecting studs 18. Preferably the studs 18 are externally screw threaded to be capable of receiving a screw threaded nut.

Preferably the hinge leafs 12,14 are each provided with internally screw threaded blind bores 19 formed in bosses 19*a* which are integrally cast with the wall 11 of each hinge leaf 12,14. An end of each stud 18 is screw threadedly received within a respective bore 19.

Each hinge leaf 12,14 preferably includes an inner face and an outer face. The internally threaded blind bores 19 are accessible from the inner face of each hinge leaf 12,14 only such that, in use, studs 18 project from the inner face of each hinge leaf 12,14.

In use, the outer face of each hinge leaf 12,14 preferably renders the studs 18 inaccessible and thereby prevents unauthorised access to the studs 18. Preventing unauthorised access to the studs 18 is particularly advantageous as a security feature which makes it difficult for the hinge assembly to be dismantled by unauthorised personnel. If desired, internally threaded bores 19 may be open-ended.

Figure 3:
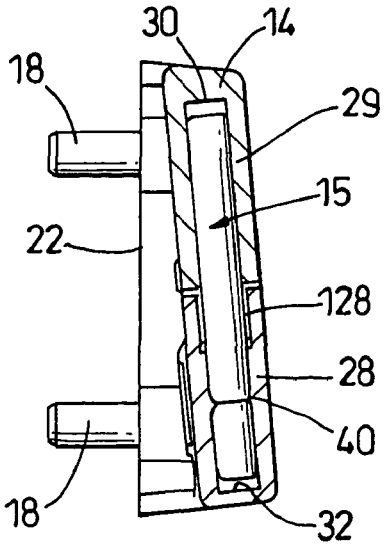
FIG. 3 is a sectional view taken along line III-III in FIG. 1.
Figure 7:
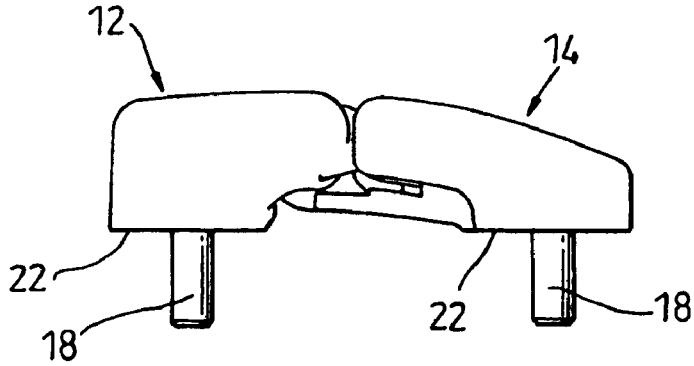
FIG. 7 is a plan view of the hinge shown in FIG. 1.

As more clearly seen in FIGS. 3, 4 and 7, the terminal faces of walls 11 of each leaf 12,14 define a generally planar abutment face 22 (or inner face) from which studs 18 project. In use, the abutment face 22 of each leaf 12,14 will abut against a support face (not shown) of the vehicle door and body respectively. As seen in FIGS. 4 and 7, the abutment faces 22 of each hinge leaf 12,14 are co-planar when the hinge leafs are angularly located at the door closed position.

As seen in FIG. 3, the axis of the hinge pin 15 is inclined relative to the plane containing abutment faces 22 and so enables the hinge assembly to be mounted on inclined support faces of the vehicle body whilst ensuring that the hinge pin 15 extends in a desired direction. This is particularly advantageous when wishing to align two opposed hinge assemblies on the support surface with their hinge pins coaxial. It will be appreciated that the amount of angular inclination of the hinge pin relative to the abutment face 22 may be varied as desired during manufacture of the hinge assembly.

It will be appreciated that the hinge of the preferred embodiment is relatively light in weight despite being cast from a relatively heavy metal such as cast iron. This is primarily due to constructing the hinge leafs in the form of thin walled shells.

It is possible that each hinge leaf 12,14 may be formed from a rolled metal section instead of being cast.

The invention claimed is:

1. A vehicle hinge assembly for hinging a vehicle door on a vehicle body, the assembly comprising a first hinge leaf hingedly connected to a second hinge leaf by a pivot pin, the pivot pin being immovably mounted in a first blind bore in one hinge leaf and being rotatably mounted in, and being axially withdrawable from, a second blind bore in the other hinge leaf, and hinge pin retention means associated with said other hinge leaf for preventing axial withdrawal of the hinge pin therefrom, the hinge pin retention means having hinge pin engagement means movably mounted on said other hinge leaf for movement between first and second positions, the engagement means including a spherical surface of a given radius seated in an annular groove of a curved section, the curved section having a radius of curvature the same as said given radius so as to permit rotation of the hinge pin but prevent any axial movement of the hinge pin relative to said other hinge leaf, and in its second position being spaced from the hinge pin to permit its axial withdrawal from said other hinge leaf, wherein said hinge pin engagement means is a ball bearing located in an externally threaded housing which is movably mounted in a threaded bore formed in said other hinge leaf for movement between said first and second positions, said housing when in said first position maintaining said ball bearing in engagement with said annular groove wherein the housing is screw threadedly mounted in said bore so as to be movable therealong by a screw action.

2. A hinge assembly according to claim 1, wherein each hinge leaf comprises a body cast from a metal to define a shell including a boss having a bore in which the hinge pin is located.

3. A hinge assembly according to claim 2 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

4. A vehicle hinge assembly for hinging a vehicle door on a vehicle body, the assembly comprising:

a first hinge leaf hingedly connected to a second hinge leaf by a pivot pin, the pivot pin being immovably mounted in one hinge leaf and being rotatably mounted in, and being axially withdrawable from, the other hinge leaf, and hinge pin retention means associated with said other hinge leaf for preventing axial withdrawal of the hinge pin therefrom, the hinge pin retention means having hinge pin engagement means movably mounted on said other hinge leaf for movement between first and second positions, the engagement means including a spherical surface of a given radius seated in an annular groove of a curved section, the curved section having a radius of curvature the same as said given radius so as to permit rotation of the hinge pin but prevent any axial movement of the hinge pin relative to said other hinge leaf, and in its second position being spaced from the hinge pin to permit its axial withdrawal from said other hinge leaf, wherein said hinge pin engagement means is a ball bearing located in an externally threaded housing which is movably mounted in a threaded bore formed in said other hinge leaf for movement between said first and second positions, said housing when in said first position maintaining said ball bearing in engagement with said annular groove wherein the housing is screw threadedly mounted in said bore so as to be movable therealong by a screw action, wherein said ball bearing is at least partially located within said housing.

5. A hinge assembly according to claim 4 wherein the housing is screw threadedly mounted in said bore so as to be movable therealong by a screw action.

6. A hinge assembly according to claim 5, the ball bearing is rotatably mounted in said housing.

7. A hinge assembly according to claim 6 wherein the ball bearing and said annular groove each have the same radius of curvature.

8. A hinge assembly according to claim 6, wherein each hinge leaf comprises a body cast from a metal to define a shell including a boss having a bore in which the hinge pin is located.

9. A hinge assembly according to claim 8 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

10. A hinge assembly according to claim 5 wherein the ball bearing and said annular groove each have the same radius of curvature.

11. A hinge assembly according to claim 5, wherein each hinge leaf comprises a body cast from a metal to define a shell including a boss having a bore in which the hinge pin is located.

12. A hinge assembly according to claim 11 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

13. A hinge assembly according to claim 4 the ball bearing and said annular groove each have the same radius of curvature.

14. A hinge assembly according to claim 13, wherein the annular groove has a depth which is less than the radius of curvature of the ball bearing.

15. A hinge assembly according to claim 13, wherein each hinge leaf comprises a body cast from a metal to define a shell including a boss having a bore in which the hinge pin is located.

16. A hinge assembly according to claim 15 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

17. A hinge assembly according to claim 4, wherein each hinge leaf comprises a body cast from a metal to define a shell including a boss having a bore in which the hinge pin is located.

18. A hinge assembly according to claim 17 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

19. A hinge assembly according to claim 4, the ball bearing is rotatably mounted in said housing.

20. A hinge assembly according to claim 4 wherein the ball bearing and said annular groove each have the same radius of curvature.

21. A hinge assembly according to claim 4, wherein each hinge leaf comprises a body cast from a metal to define a shell including a boss having a bore in which the hinge pin is located.

22. A hinge assembly according to claim 21 wherein the bore housing said ball bearing is formed in a wall projection integrally cast with said boss of said other hinge leaf, said wall projection being interleaved with said one hinge leaf over a predetermined angular range of movement about said hinge pin in order to prevent axial separation of the hinge leafs.

* * * * *